United States Patent [19]

Branovich et al.

[11] Patent Number: 4,957,463

[45] Date of Patent: Sep. 18, 1990

[54] METHOD OF MAKING A LONG LIFE HIGH CURRENT DENSITY CATHODE FROM TUNGSTEN AND IRIDIUM POWDERS USING A QUATERNARY COMPOUND AS THE IMPREGNANT

[75] Inventors: Louis E. Branovich, Howell; Bernard Smith, Ocean; Gerard L. Freeman, Freehold; Donald W. Eckart, Wall, all of N.J.

[73] Assignee: The United States of America as represented by the Secretary of the Army, Washington, D.C.

[21] Appl. No.: 459,629

[22] Filed: Jan. 2, 1990

[51] Int. Cl.[5] ..... H01J 9/04

[52] U.S. Cl. ..... 445/50; 445/51

[58] Field of Search ..... 445/50, 51

[56] References Cited

U.S. PATENT DOCUMENTS

| | | | |
|---|---|---|---|
| 4,735,591 | 4/1988 | Branovich et al. | 445/50 |
| 4,863,410 | 9/1989 | Branovich et al. | 445/50 |
| 4,894,257 | 1/1990 | Smith et al. | 445/50 X |
| 4,910,079 | 3/1990 | Shroff et al. | 445/51 X |

*Primary Examiner*—Kenneth J. Ramsey

*Attorney, Agent, or Firm*—Michael Zelenka; Roy E. Gordon

[57] ABSTRACT

A long life high current density cathode is made from a mixture of tungsten and iridium powders by processing the mixture of powders with an activator into a porous billet, and then impregnating the billet with a quaternary compound including barium, oxygen, a metal selected from the group consisting of osmium, iridium, rhodium, and rhenium, and a metal selected from the group consisting of strontium, calcium, scandium and titanium, by firing the billet in a dry hydrogen furnace at a temperature at which the impregnant melts.

8 Claims, No Drawings

METHOD OF MAKING A LONG LIFE HIGH CURRENT DENSITY CATHODE FROM TUNGSTEN AND IRIDIUM POWDERS USING A QUATERNARY COMPOUND AS THE IMPREGNANT

The invention described herein may be manufactured, used and licensed by or for the Government for governmental purposes without the payment to us of any royalty thereon. This invention relates in general to a method of making a long life high current density cathode and in particular, to a method of making such a cathode from a porous billet formed from a mixture of tungsten and iridium powders using a quaternary compound including barium, oxygen, a metal selected from the group consisting of osmium, iridium, rhodium, and rhenium, and a metal selected from the group consisting of strontium, calcium, scandium, and titanium as the impregnant for the porous billet.

BACKGROUND OF THE INVENTION

Quaternary compounds or compounds including four elements such as $Ba_2SrWO_6$ and $Ba_2CaAl_2O_6$ have been used heretofore as impregnants in the manufacture of high current density cathodes. One of the difficulties with these compounds as cathode impregnants has been their lack of superior emissive characteristics. This has been largely due to the lack of certain emission improving elements such as osmium, iridium and rhenium within the impregnant.

SUMMARY OF THE INVENTION

The general object of this invention is to provide a method of making a cathode having a long life and a high current density. A more particular object of the invention is to provide such a method that uses a quaternary compound as the impregnant.

It has now been found that the aforementioned objects can be attained by making such a cathode from a porous billet formed from a mixture of tungsten and iridium powders using a quaternary compound including barium, oxygen, a metal selected from the group consisting of osmium, iridium, rhodium, and rhenium, and a metal selected from the group consisting of strontium, calcium, scandium, and titanium as the impregnant for the porous billet.

Quaternary compounds that can be used as impregnants in the method of the invention include $Ba_2ScOsO_6$, $Ba_2ScReO_6$, $Ba_2SrOsO_6$ and $Ba_3IrTi_2O_9$.

In the case of the use of $Ba_2SrOsO_6$ as the quaternary compound for example, 1/10 or 10 percent of the molecule is osmium that can be distributed over the entire porous billet evenly. The osmium generated acts as a catalyst. This catalyst is superior in point of emission to the osmium in a porous tungsten-osmium billet. This is because the distribution of the osmium in the tungsten-osmium billet is only on the surface and a fraction of the pores. Even if the pores were distributed evenly and of the same pore size, catalytic action would take place on the wall of the pores or on the surface of the Tungsten-osmium billet only When the quaternary compound $Ba_2SrOsO_6$ is used on the other hand, the impregnant with 10 percent of its molecule to act as a catalyst and with the impregnant distributed in the pores and on the surface, more catalyst surface is available for surface reaction and therefore, more emission at lower temperatures.

DESCRIPTION OF THE PREFERRED EMBODIMENT

Tungsten and iridium powders are mixed in the weight ratio of about 60 weight percent tungsten to about 39 weight percent iridium. About 1 weight percent of an activator such as zirconium hydride is added to the mixture. The mixture is ball milled for about 8 hours and the ball milled mixture then pressed into a billet at about 48,00 p.s.i. in a die. The billet is sintered at about 1800° C. for about thirty minutes in dry hydrogen of less than 100 dewpoint and the billet then backfilled with copper in dry hydrogen at about 1150° C. The billet is machined to the desired geometry and the copper then removed by etching in nitric acid. The billet is then thoroughly rinsed in deionized water, methanol and then dried The tungsten-iridium billet is fired in dry hydrogen to about 1400° C. for about 15 minutes and then impregnated with $Ba_2ScOsO_6$ by firing the billet in a dry hydrogen furnace at about 1000° C. for about 2 minutes. The billet is removed from the furnace after the furnace is cooled, and any loose pieces of impregnant are removed from the billet.

The cathode operation is similar to other cathode operations. That is, it is heated in vacuum, and a chemical reaction takes place and barium atoms are released that coat the cathode surface.

The quaternary compounds that can be used as impregnants in the method of the invention can be impregnated directly on a tungsten billet, or a tungsten-osmium billet or a tungsten-rhodium billet or a tungsten-rhenium billet, etc. The particles of quaternary compound can even be coated with tungsten by a chemical vapor deposition method and then mixed with barium peroxide in a 1:1 to 1:3 molar ratio of barium peroxide to coated impregnant giving rise to a lower temperature of impregnation of about 800° C. to 900° C.

We wish it to be understood that we do not desire to be limited to the exact details of construction as described for obvious modifications will occur to a person skilled in the art.

What is claimed is:

1. Method of making a long life high current density cathode suitable for operation in microwave devices from tungsten and iridium powders using a quaternary compound including barium, oxygen, a metal selected from the group consisting of osmium, iridium, rhodium, and rhenium, and a metal selected from the group consisting of strontium, calcium, scandium, and titanium as the impregnant, said method including the steps of:

(A) mixing the tungsten and iridium powders in a weight ratio of about 60 weight percent tungsten to about 39 weight percent iridium, (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about ½ hour in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen to about 1400° C. for about 15 minutes, (K) impregnating the billet with a quaternary compound including barium, oxygen, a metal selected from the group consisting of osmium, iridium, rhodium and rhenium, and a metal selected from the group consisting of strontium, calcium, scandium, and titanium as the impregnant by firing the billet in a dry hydrogen furnace at a temperature at which the impregnant melts, (L) removing the billet from the furnace after the furnace is cooled, and (M) removing any loose pieces of impregnant from the billet.

2. Method according to claim 1 wherein the quaternary compound used as the impregnant is selected from the group consisting of $Ba_2ScOsO_6$, $Ba_2ScReO_6$, $Ba_2SrOsO_6$, and $Ba_3IrTi_2O_9$.

3. Method according to claim 2 wherein the quaternary compound used as the impregnant is $Ba_2ScOsO_6$.

4. Method according to claim 2 wherein the quaternary compound used as the impregnant is $Ba_2ScReO_6$.

5. Method according to claim 2 wherein the quaternary compound used as the impregnant is $Ba_2SrOsO_6$.

6. Method according to claim 2 wherein the quaternary compound used as the impregnant is $Ba_3IrTi_2O_9$.

7. Method according to claim 1 wherein prior to impregnation particles of the quaternary compound to be used as the impregnant are coated by chemical vapor deposition with tungsten and mixed with barium peroxide in molar ratio of 1:1 to 1:3 BaO to coated impregnant.

8. Method of making a long life high current density cathode suitable for operation in microwave devices from tungsten and iridium powders using the quaternary compound, $Ba_2ScOsO_6$, as the impregnant, said method including the steps of:

(A) mixing the tungsten and iridium powders in a weight ratio of about 60 weight percent tungsten to about 39 weight percent iridium, (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about ½ hour in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen to about 1400° C. for about 15 minutes, ((K)) impregnating the billet with the quaternary compound, $Ba_2ScOsO_6$, by firing the billet in a dry hydrogen furnace at about 1000° C. for about 2 minutes, (L) removing the billet from the furnace after the furnace is cooled, and (M) removing any loose pieces of impregnant from the billet.

(L) removing the billet from the furnace after the furnace is cooled, and (M) removing any loose pieces of impregnant from the billet.

* * * * *